US009903082B2

(12) United States Patent
Wang et al.

(10) Patent No.: US 9,903,082 B2
(45) Date of Patent: Feb. 27, 2018

(54) COFFERDAM DEFORMATION-ADAPTIVE IMPERVIOUS STRUCTURE AND CONSTRUCTION METHOD OF COMPOSITE GEOMEMBRANE

(71) Applicant: POWERCHINA HUADONG ENGINEERING CORPORATION LIMITED, Hangzhou, Zhejiang province (CN)

(72) Inventors: Yongming Wang, Hangzhou (CN); Jianguo Cai, Hangzhou (CN); Xianpei Liang, Hangzhou (CN); Jinming Ren, Hangzhou (CN); Yuan Deng, Hangzhou (CN); Jun Li, Hangzhou (CN); Guanye Wu, Hangzhou (CN); Lei Huang, Hangzhou (CN)

(73) Assignee: POWERCHINA HUADONG ENGINEERING CORPORATION LIMITED, Hangzhou (CN)

( * ) Notice: Subject to any disclaimer, the term of this patent is extended or adjusted under 35 U.S.C. 154(b) by 99 days.

(21) Appl. No.: 15/243,935

(22) Filed: Aug. 22, 2016

(65) Prior Publication Data

US 2017/0198451 A1 Jul. 13, 2017

(30) Foreign Application Priority Data

Jan. 8, 2016 (CN) ..... 2016 1 0013468

(51) Int. Cl.
*E02B 3/16* (2006.01)
*E02B 7/06* (2006.01)

(52) U.S. Cl.
CPC . *E02B 3/16* (2013.01); *E02B 7/06* (2013.01)

(58) Field of Classification Search
CPC . E02B 3/16; E02B 3/122; E02B 3/126; E02B 7/06; E02B 7/54; E02D 29/16; E04B 1/68; E04B 1/665; E04B 1/6807; E04B 1/6815; E04B 1/66; E01D 19/06
See application file for complete search history.

(56) References Cited

U.S. PATENT DOCUMENTS 1,793,083 A * 2/1931 Green ..... E01D 19/06 404/47
4,925,339 A * 5/1990 Smith ..... E01D 19/086 404/2
8,826,481 B1 * 9/2014 Haydu ..... E01D 19/06 14/73.5

(Continued)

*Primary Examiner* — Carib Oquendo
(74) *Attorney, Agent, or Firm* — PROI Intellectual Property US

(57) ABSTRACT

The present invention relates to a cofferdam deformation-adaptive impervious composite geomembrane structure and construction method thereof, which applies mainly to high rockfill cofferdam, earth and rockfill dam and the like employing composite geomembranes for seepage control in hydraulic and hydro-power engineering. The cofferdam deformation-adaptive impervious composite geomembrane structure and construction method according to the present invention can reduce damage degree of the connections between the composite geomembranes and the concrete toe slabs or the joints between the composite geomembranes and the concrete caps on the top of the concrete impervious walls.

7 Claims, 3 Drawing Sheets

(56) References Cited

U.S. PATENT DOCUMENTS

| | | | | |
|---|---|---|---|---|
| 2002/0088192 | A1* | 7/2002 | Calixto | E04B 1/6816<br>52/396.04 |
| 2011/0135387 | A1* | 6/2011 | Derrigan | E01C 11/106<br>404/69 |
| 2017/0058469 | A1* | 3/2017 | Morii | E01D 19/06 |

* cited by examiner

COFFERDAM DEFORMATION-ADAPTIVE IMPERVIOUS STRUCTURE AND CONSTRUCTION METHOD OF COMPOSITE GEOMEMBRANE

CROSS REFERENCE TO RELATED APPLICATIONS

The present application claims priority to Chinese Patent Application CN 2016 100 134 68.3 filed on Jan. 8, 2016.

TECHNICAL FIELD

The present invention relates to a cofferdam deformation-adaptive impervious composite geomembrane structure and construction method thereof, which applies mainly to high rockfill cofferdam, earth and rockfill dam and the like employing composite geomembranes for seepage control in hydraulic and hydro-power engineering.

BACKGROUND

With the implementation of China's western development strategy, the height and size of the earth rock cofferdam has increased year by year. Due to the convenience and economy of the construction, inclined wall type composite geomembranes are employed in many cofferdams. As the technical difficulty of high rockfill cofferdam increases with the increasing cofferdam scale, at joints of the composite geomembranes and the shoreside toe slabs or connections of the composite geomembranes and impervious walls, due to water pressure and gravity, the cofferdams are integrally deformed and produce a relative displacement from the rigid connection. Moreover, this relative displacement is only taken by the composite geomembranes in extremely small area around the connections. If the expansion joints are disposed improperly, the composite geomembranes will produce obvious strain, and then the tensile or shear failure occurs. The failure phenomenon has been observed during running or removing of a number of earth rock cofferdams, connections between the composite geomembranes and the shoreside toe slabs or joints between the composite geomembranes and the concrete caps on the top of the impervious walls are damaged at different extents. The failure mechanism has been proved by centrifugal model test and numerical calculation.

At the connections between the composite geomembranes and shoreside toe slabs as well as the connections between composite geomembranes and impervious walls, because the composite geomembranes are paved on granular padding materials with lower modulus, a larger relative shift occurs compared to the rigid connections. In the past, many projects have dispoosed expansion joints in the connection area, but the expansion joints are simply compacted by overlying rock filling materials and water loading to work out.

SUMMARY

The technical problem to be solved by the present invention is that: in view of the above problems, the present invention provides a cofferdam deformation-adaptive impervious composite geomembrane structure and construction method thereof, which are intended to reduce damage degree of the connections between the composite geomembranes and the concrete toe slabs or the joints between the composite geomembranes and the concrete caps on the top of the concrete impervious walls.

The technical scheme adopted by the invention is: a cofferdam deformation-adaptive composite geomembrane impervious structure, comprising a concrete structure and a padding layer connected to the concrete structure, and a composite geomembrane with an impervious function provided between the concrete structure and the padding layer, wherein the composite geomembrane comprises an upper protective layer polyethylene (PE) membrane, a lower protective layer polyethylene (PE) membrane, a U-shaped expansion joint and an assistive horizontal expansion joint, wherein the U-shaped expansion joint is vertically disposed with a U-shaped open end facing upward, one end of the U-shaped expansion joint is fixed to the concrete structure and the other end of the U-shaped expansion joint extend horizontally and is connected to one end of the assistive horizontal expansion joint, and the other end of the assistive horizontal expansion joint is connected to other impervious geomembranes of the cofferdam; one ends of both of the upper protective layer PE membrane and lower protective layer PE membrane are bonded to the concrete structure, and the other ends comply with shapes of the U-shaped expansion joint and the assistive horizontal expansion joint to cover and synchronously extend outwardly; and the assistive horizontal expansion joint is a two-way three-tier horizontally folded structure.

A U-shaped groove of the U-shaped expansion joint is filled with foamed plates.

A glossy PE membrane is lined between two folding contact surfaces of the assistive horizontal expansion joint, and a lead-out joint for splicing is set aside at the tail end of the assistive horizontal expansion joint.

The concrete structure is a concrete toe slab, wherein one side of the toe slab is provided with shoreside bed rocks and the other side is connected to the padding layer, the bottom plate of the concrete toe slab is connected to the shoreside bed rocks through anchor bars and consolidation grouting and is provided with a grouting curtain along the axis of the concrete toe slab, the inner end of the U-shaped expansion joint is pre-embedded in the concrete toe slab, the inner ends of the upper protective layer PE membrane and the lower protective layer PE membrane are bonded to a surface of the concrete toe slab through asphalt, and subsequent parts of the upper protective layer PE membrane and the lower protective layer PE membrane are coated on surfaces of the U-shaped expansion joint and the assistive horizontal expansion joint.

The concrete structure is a concrete impervious wall, an upper end of the impervious wall is a concrete cap and a guide wall; wherein the inner end of the U-shaped expansion joint is pre-embedded in the concrete cap, and the inner ends of the upper PE membrane and the lower protective layer PE membrane are bonded to a surface of the concrete cap through asphalt, and subsequent parts of the upper protective layer PE membrane and lower protective layer PE membrane are coated on surfaces of the U-shaped expansion joint and the assistive horizontal expansion joint.

A construction method of the composite geomembrane impervious structure is disclosed, which comprises the following steps:

a. setting the concrete toe slab and an impervious system: one side of the concrete toe slab is provided with shoreside bed rocks and the other side is connected to the padding layer, the bottom plate of the concrete toe slab is connected to the shoreside bed rocks through anchor bars and consolidation grouting and is provided with a grouting curtain along the axis of the concrete toe slab; the concrete toe slab has a thickness of 1.5 m, and settlement joints are provided on the concrete toe slab along direction of axis thereof every 9-12 m; and the grouting curtain has a depth ranged within 5 Lu~10 Lu;

b. setting the padding layer: the padding layer is prepared by employing well-graded natural gravels or artificial sand-mixed natural gravels, filling and compacting, with a thickness of 60 cm and a maximum particle diameter less than 4 cm;

c. pasting and paving the lower protective layer PE membrane: a layer of asphalt with a thickness of 0.2 mm is brush coated on a side wall of the concrete toe slab (1) according to depth of one swing of the subsequent U-shaped expansion joint (7), one end of the lower protective layer PE membrane is bonded to the asphalt surface and the other end complies with the lower surface shapes of the U-shaped expansion joint (7) and the assistive horizontal expansion joint (9) to cover and synchronously extend outwardly; and the lower protective layer PE membrane is made of a glossy high density polyethylene (HDPE) material, with a membrane thickness of 0.2 mm;

d. paving the U-shaped expansion joint: the U-shaped expansion joint is vertically provided, with a U-shaped open end upward, one end of the U-shaped expansion joint is pre-embedded in the concrete toe slab, with a pre-embedding length greater than 150 cm, the other end horizontally extends outwardly, the U-shaped expansion joint has a unidirectional height of 25 cm and is filled therein with foamed plates with a thickness of 2 cm;

e. paving the assistive horizontal expansion joint: the assistive horizontal expansion joint which is connected to one end of the U-shaped expansion joint at the top surface of the U-shaped expansion joint and at a position 10-20 cm away from the U-shaped expansion joint, is set, the other end of the assistive horizontal expansion joint is connected to other impervious geomembranes of the cofferdam; and the horizontal expansion joint is a two-way three-tier horizontally folded structure, a width of both sides to the center is 25 cm, and a glossy PE membrane with a thickness of 0.2 mm is used for separating the two folding contact surfaces;

f. pasting and paving the upper layer PE membrane: a layer of asphalt with a thickness of 0.2 mm is brush coated on side walls of the concrete toe slab, one end of the upper layer PE membrane is bonded to the asphalt surface, and the other end complies with upper surface shapes of the U-shaped expansion joint and the assistive horizontal expansion joint to cover and synchronously extend outwardly; and a length beyond the assistive horizontal expansion joint is greater than 10 cm; and g. setting aside the lead-out joint: the lead-out joint for splicing is set aside at the tail end of the assistive horizontal expansion joint and a geotextile terminal is stripped by 50 cm to make the main membrane exposed, the lead-out joint and a large area of the composite geomembranes at the upstream face of the cofferdam are welded; and finally, a concrete protective layer is sprayed above the upper protective layer PE membrane.

Another construction method of the composite geomembrane impervious structure according to the present invention is disclosed, which comprises the following steps:

a. setting the concrete impervious wall and an impervious system: the upper end of the concrete impervious wall is provided with the concrete cap and the guide wall, and both sides of the concrete cap are connected to the padding layer;

b. setting the padding layer: the padding layer is prepared by employing well-graded natural gravels or artificial sand-mixed natural gravels, filling and compacting, with a thickness of 60 cm and a maximum particle diameter less than 4 cm;

c. pasting and paving the lower protective layer PE membrane: a layer of asphalt with a thickness of 0.2 mm is brush coated on a side wall of the concrete cap according to depth of one swing of the subsequent U-shaped expansion joint, one end of the lower protective layer PE membrane is bonded to the asphalt surface and the other end complies with the lower surface shapes of the U-shaped expansion joint and the assistive horizontal expansion joint to cover and synchronously extend outwardly; and the lower protective layer PE membrane is made of a glossy HDPE material, with a membrane thickness of 0.2 mm;

d. paving the U-shaped expansion joint: the U-shaped expansion joint is vertically provided, with a U-shaped open end upward, one end of the U-shaped expansion joint is pre-embedded in the concrete cap, with a pre-embedding length greater than 150 cm, the other end horizontally extends outwardly, and the U-shaped expansion joint has a unidirectional height of 25 cm and is filled therein with foamed plates with a thickness of 2 cm;

e. paving the assistive horizontal expansion joint: the assistive horizontal expansion joint which is connected to one end of the U-shaped expansion joint at the top surface of the U-shaped expansion joint and at a position 10-20 cm away from the U-shaped expansion joint, is set, the other end of the assistive horizontal expansion join is connected to other impervious geomembranes of the cofferdam; and the horizontal expansion joint is a two-way three-tier horizontally folded structure, a width from both sides to the center is 25 cm, and a glossy PE membrane with a thickness of 0.2 mm is used for separating the two folding contact surfaces;

f. pasting and paving the upper layer PE membrane: a layer of asphalt with a thickness of 0.2 mm is brush coated on side walls of the concrete cap, one end of the upper layer PE membrane is bonded to the asphalt surface, and the other end complies with upper surface shapes of the U-shaped expansion joint and the assistive horizontal expansion joint to cover and synchronously extend outwardly; and a length beyond the assistive horizontal expansion joint is greater than 10 cm; and g. setting aside the lead-out joint: the lead-out joint for splicing is set aside at the tail end of the assistive horizontal expansion joint and a geotextile terminal is stripped by 50 cm to make the main membrane exposed, the lead-out joint and a large area of the composite geomembranes at the upstream face of the cofferdam are welded; and finally, a compacted well-graded granular material protective layer is spread above the upper protective layer PE membrane.

The invention has the advantages that: the invention relates to a cofferdam deformation-adaptive composite geomembrane impervious structure and construction method thereof for controlling strain concentration in the composite geomembranes at connections of impervious walls of concrete toe slabs and riverbed sites for inclined wall composite geomembrane high rockfill cofferdam bank slopes, alleviates overall deformation of cofferdam and relative displacement produced at the rigid connections, which are caused by water pressure and gravity at the connections of the composite geomembranes and the concrete toe slabs or joints of the composite geomembranes and the concrete impervious walls. The invention reduces obvious strain concentration and tensile or shear failure produced in the composite geomembranes, namely, reducing the damage degree at the connections of the composite geomembranes and the concrete toe slabs or joints of the composite geomembranes and the concrete caps on the top of the concrete impervious walls.

DETAILED DESCRIPTION

Figure 1:
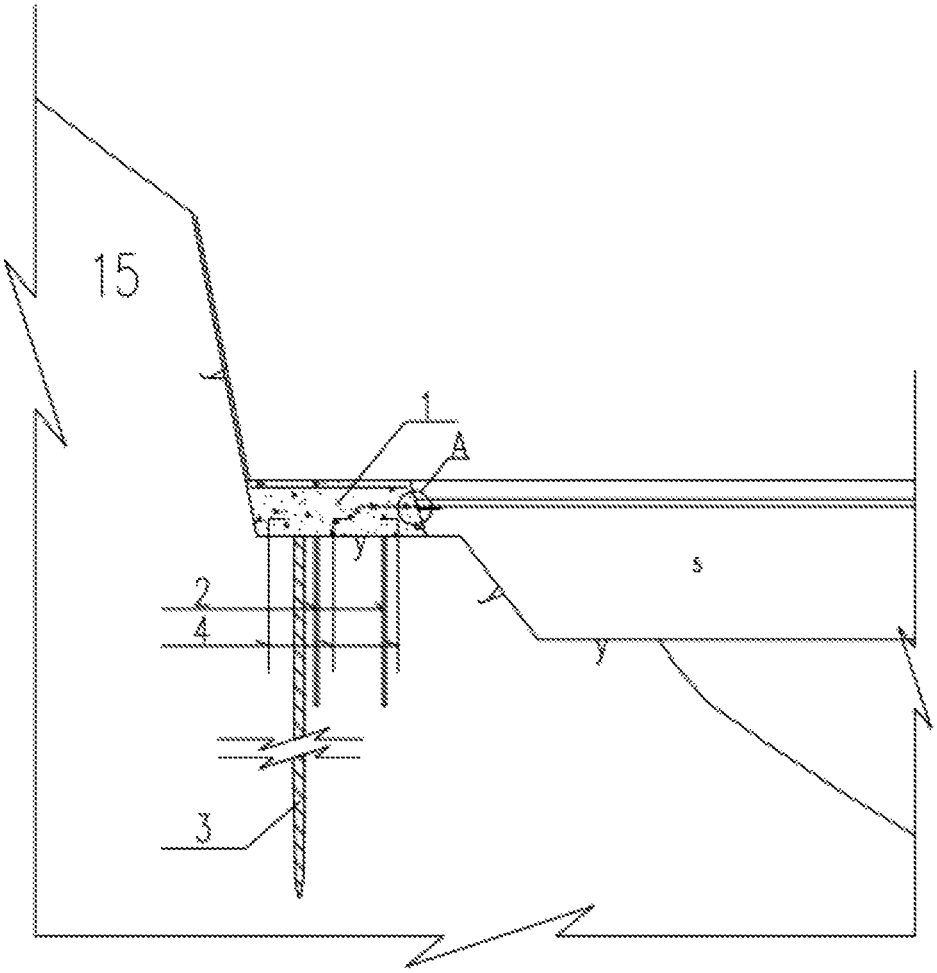
FIG. 1 is a profile layout of Embodiment 1 of the present invention.

The present invention provides to a cofferdam deformation-adaptive impervious composite geomembrane structure and construction method thereof, which applies mainly to high rockfill cofferdam, earth and rockfill dam and the like employing composite geomembranes for seepage control in hydraulic and hydro-power engineering.

The impervious structure includes a concrete structure (including a concrete toe slab or a concrete impervious wall) and a padding layer 5 connected to the concrete structure, and the composite geomembrane having an impervious function provided between the concrete structure and the padding layer; when the composite geomembrane impervious structure is applied to high rockfill cofferdam bank slopes, the concrete structure is a concrete toe slab 1; and when the composite geomembrane impervious structure is applied to riverbed sections, the concrete structure is a concrete impervious wall 12; and the composite geomembrane comprises an upper protective layer PE membrane 10, a lower protective layer PE membrane 6, a U-shaped expansion joint 7 and an assistive horizontal expansion joint 9.

The U-shaped expansion joint 7 is vertically provided, with a U-shaped open end facing upward and a U-shaped groove filled with foamed plates 8 having a thickness of 2 cm; wherein one end of the U-shaped expansion joint 7 is fiexed in the concrete structure and the other end horizontally extends and is connected to one end of the assistive horizontal expansion joint 9, the other end of the assistive horizontal expansion joint 9 is connected to other impervious geomembranes of the cofferdam; the assistive horizontal expansion joint 9 is a two-way three-tier horizontally folded structure, a glossy PE membrane is used for separating the two folding contact surfaces of the assistive horizontal expansion joint 9, and a lead-out joint 11 for splicing is set aside at the tail end of the assistive horizontal expansion joint 9; one ends of both of the upper protective layer PE membrane 10 and lower protective layer PE membrane 6 are bonded to the concrete structure, and the other end complies with shapes of the U-shaped expansion joint 7 and the assistive horizontal expansion joint 9 to cover and synchronously extend outwardly. Hereinafter, the present invention provided structures and methods respectively applied in the concrete toe slabs and the concrete impervious walls are discussed in detail.

Embodiment 1

Figure 2:
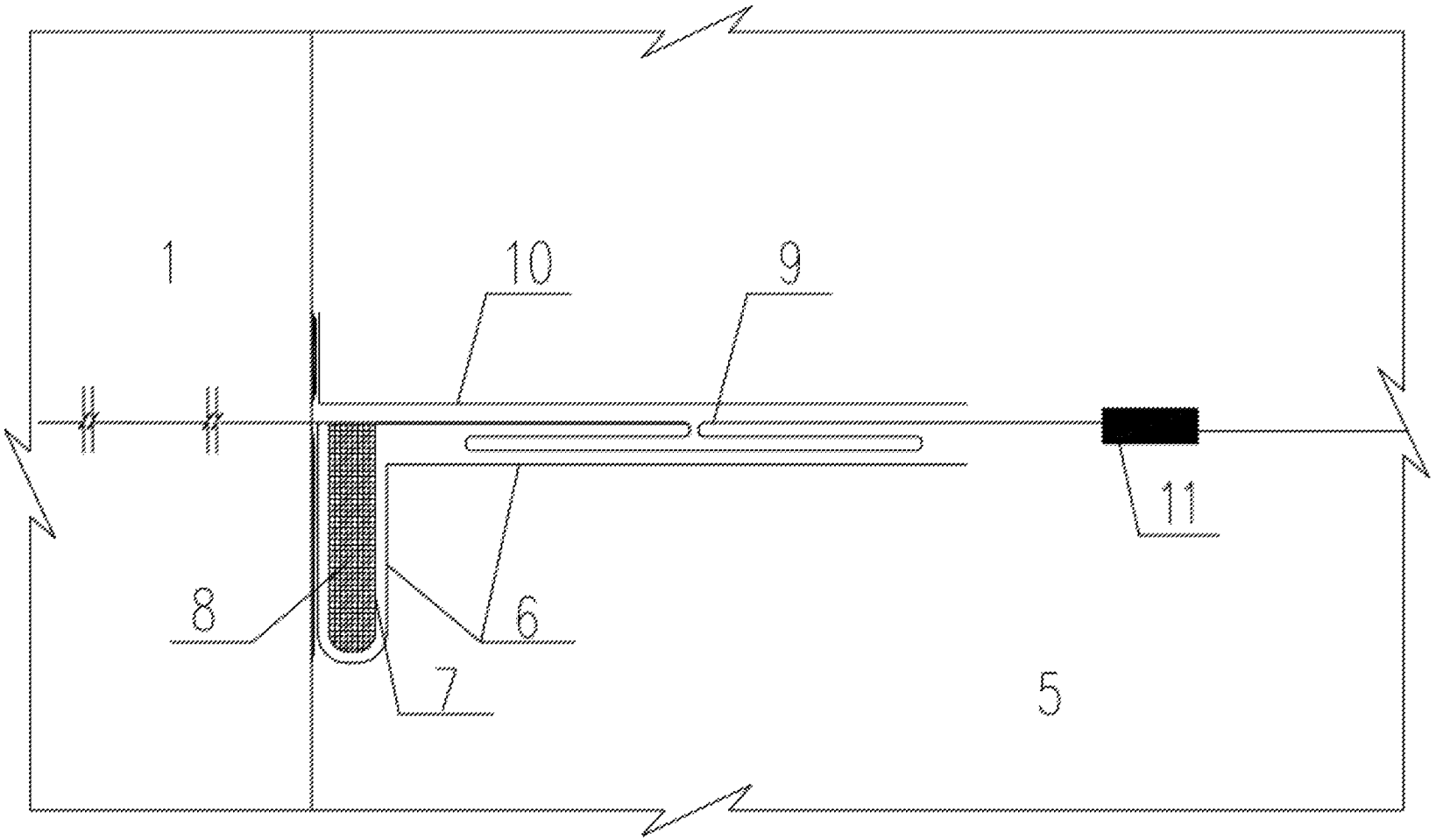
FIG. 2 is an enlarged view of site A of the present invention.

As seen from FIG. 1 and FIG. 2, the concrete structure of this embodiment is a concrete toe slab 1, wherein one side of the toe slab is provided with shoreside bed rocks 15 and the other side is connected to the padding layer 5, the bottom plate of the concrete toe slab 1 is connected to the shoreside bed rocks through anchor bars 4 and consolidation grouting 2 and is provided with a grouting curtain 3 along the axis of the concrete toe slab 1, the inner end of the U-shaped expansion joint 7 is pre-embedded in the concrete toe slab 1, the inner ends of the upper protective layer PE membrane 10 and the lower protective layer PE membrane 6 are bonded to a surface of the concrete toe slab 1 through brush coating an asphalt layer with a thickness of 0.2 mm, and subsequent parts of the upper protective layer PE membrane 10 and the lower protective layer PE membrane 6 are respectively coated on the upper surface of the U-shaped expansion joint 7 and the lower surface of the assistive horizontal expansion joint 9.

A construction method according to 1 comprises the following steps:

a. setting the concrete toe slab 1 and an impervious system: one side of the concrete toe slab is provided with shoreside bed rocks 15 and the other side is connected to the padding layer 5, the bottom plate of the concrete toe slab 1 is connected to the shoreside bed rocks through anchor bars 4 and consolidation grouting 2 and is provided with a grouting curtain 3 along the axis of the concrete toe slab 1; the concrete toe slab 1 has a thickness of 1.5 m, the overall axis layout of the concrete toe slab 1 is in smooth transition, without a larger corner to ensure a smooth connection of the composite geomembranes, and settlement joints are provided on the concrete toe slab 1 along direction of axis thereof every 9-12 m; and the grouting curtain 3 has a depth ranged within 5 Lu~10 Lu (Lu: lugeon, unit of rock permeability);

b. setting the padding layer 5: a rock ballast cofferdam body is set below the padding layer 5, and the padding layer 5 is prepared by employing well-graded natural gravels or artificial sand-mixed natural gravels, filling and compacting, with a thickness of 60 cm and a maximum particle diameter less than 4 cm; filling of the padding layer 5 is divided into two phases, in the first phase, the padding layer 5 is filled at the bottom of the U-shaped expansion joint 7, and in the second phase, after the U-shaped expansion joint is bended and paved to the required site, the padding layer 5 is filled at the bottom of the assistive horizontal expansion joint 9; in order to reduce overall deformation of the composite geomembrane, a mini-type vibrating roller is employed to roll the padding layer 5 during filling, thereby, obtaining a larger deformation modulus;

c. pasting and paving the lower protective layer PE membrane 6: in order to prevent damage from outside force during construction and running of the lower surface of the U-shaped expansion joint 7, the lower protective layer PE membrane 6 is required, the lower protective layer PE membrane 6 with a thickness of 0.2 mm is made of glossy PE materials, which can isolate direct contact friction between the impervious composite geomembrane and the rough surface of the concrete toe slab, also can isolate contact friction, bursting and penetration between the composite geomembrane and the padding layer 5, effectively protecting the impervious layer; meanwhile, a low-friction coefficient contact surface provided by the glossy PE membrane, is capable of making the expansion joint freely slide to adapt deformation; paving and bending manners of the lower protective layer PE membrane 6 are kept consistent with the subsequent expansion joints, in order to locate easily, an asphalt layer with a thickness of 0.2 mm is brushed coated on side walls of the concrete toe slab 1 according to depth of one swing of the subsequent U-shaped expansion joint 7, then one end of the lower protective layer PE membrane is bonded and fixed to side walls of the concrete toe slab 1, the other parts are lined at the lower part of the U-shaped expansion joint, that is, complying with the lower surface shapes of the U-shaped expansion joint 7 and the assistive horizontal expansion joint 9 to cover and synchronously extend outwardly;

d. paving the U-shaped expansion joint 7: the U-shaped expansion joint 7 is vertically provided, with a U-shaped open end upward, one end of the U-shaped expansion joint 7 is pre-embedded in the concrete toe slab 1, with a pre-embedding length greater than 150 cm, the other end horizontally extends outwardly, the U-shaped expansion joint 7 has a unidirectional height of 25 cm (which can be determined by the relative deformation between the composite geomembrane and the concrete toe slab 1); in order to prevent spreading failure of the composite geomembranes after direct contact at both sides of the U-shaped expansion joint, wherein a higher friction force is produced between the composite geomembranes; the U-shaped expansion joint is filled therein with foamed plates with a thickness of 2 cm, and after the foamed plates are set, the padding layer is used for embedding the U-shaped expansion joint;

e. paving the assistive horizontal expansion joint 9: the assistive horizontal expansion joint 9 is required to assist the U-shaped expansion joint 7 and to prevent cofferdam deformation larger than the designed scope of the U-shaped expansion joint 7 due to cofferdam padding material property or poor construction quality; the assistive horizontal expansion joint 9 which is connected to one end of the U-shaped expansion joint 7 at the top surface of the U-shaped expansion joint 7 and at a position 10-20 cm away from the U-shaped expansion joint 7 is set, the other end of the assistive horizontal expansion joint 9 is connected to other impervious geomembranes of the cofferdam; and the horizontal expansion joint is a two-way three-tier horizontally folded structure, a width from both sides to the center is 25 cm, and a glossy PE membrane with a thickness of 0.2 mm is used for separating the two folding contact surfaces, to reduce friction force between folding contact surfaces of the horizontal expansion joints, which is beneficial to making the horizontal expansion joints spread and come into play;

f. pasting and paving the upper layer PE membrane 10: a layer of asphalt with a thickness of 0.2 mm is brush coated on side walls of the concrete toe slab 1, one end of the upper layer PE membrane 10 is bonded to the asphalt surface, and the other end complies with upper surface shapes of the U-shaped expansion joint 7 and the assistive horizontal expansion joint 9 to cover and synchronously extend outwardly; and a length beyond the assistive horizontal expansion joint 9 is greater than 10 cm; the upper protective layer PE membrane 10 has the same working mechanism with the lower protective layer PE membrane 6, and protects the upper surface of the expansion joint from damage from outside force during construction and running phases, meanwhile, the upper protective layer PE membrane 10 also provides a low-friction force contact surface to make the expansion joint slide and be deformed; and g. setting aside the lead-out joint 11: the lead-out joint (11) is set aside for splicing at the tail end of the assistive horizontal expansion joint 9 and a geotextile terminal is stripped by 50 cm to make the main membrane exposed, the lead-out joint and a large area of the composite geomembranes at the upstream face of the cofferdam are welded; and finally, a concrete protective layer is sprayed above the upper protective layer PE membrane (10).

Embodiment 2

Figure 3:
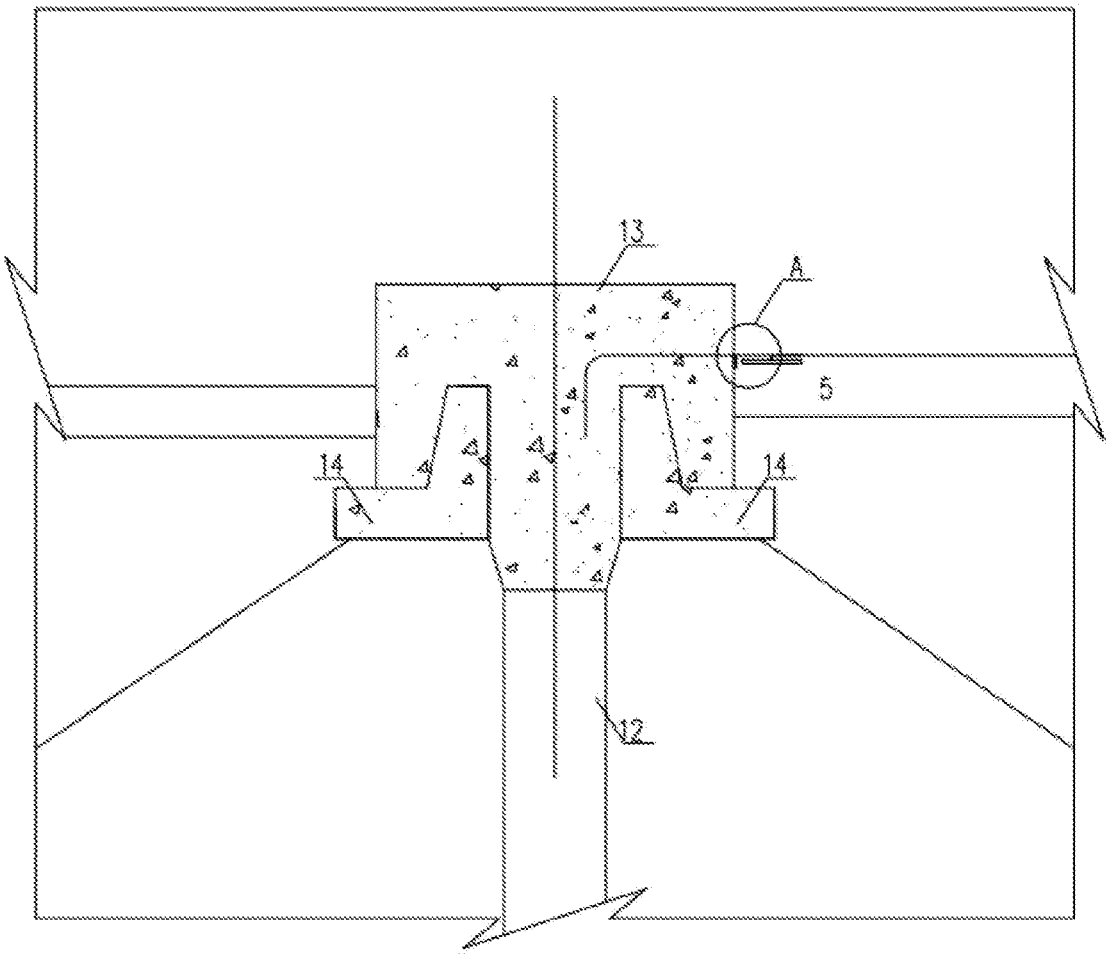
FIG. 3 is a profile layout of Embodiment 2 of the present invention.

As seen from FIG. 2 and FIG. 3, the concrete structure of example 2 is a concrete impervious wall 12, an upper end of the impervious wall is a concrete cap 13 and a guide wall 14; the inner end of the U-shaped expansion joint 7 is pre-embedded in the concrete cap 13, and the inner ends of the upper protective layer PE membrane 10 and the lower protective layer PE membrane 6 are bonded to a surface of the concrete cap 13 through brush coating an asphalt layer with a thickness of 0.2 mm, and subsequent parts of the upper protective layer PE membrane 10 and the lower protective layer PE membrane 6 are coated on the upper surface of the U-shaped expansion joint 7 and the lower surface of the assistive horizontal expansion joint 9.

A construction method according to Embodiment 2 comprises the following steps:

a. setting the concrete impervious wall 12 and an impervious system: the upper end of the concrete impervious wall is the concrete cap 13 and the guide wall 14, and both sides of the concrete cap 13 are connected to the padding layer 5;

b. setting the padding layer 5: a rock ballast cofferdam body is set below the padding layer 5, and the padding layer 5 is prepared by employing well-graded natural gravels or artificial sand-mixed natural gravels, filling and compacting, with a thickness of 60 cm and a maximum particle diameter less than 4 cm; filling of the padding layer 5 is divided into two phases, in the first phase, the padding layer 5 is filled at the bottom of the U-shaped expansion joint 7, and in the second phase, after the U-shaped expansion joint is bended and paved to the required site, the padding layer 5 is filled at the bottom of the assistive horizontal expansion joint 9; in order to reduce overall deformation of the composite geomembrane, a mini-type vibrating roller is employed to roll the padding layer 5 during filling, thereby, obtaining a larger deformation modulus;

c. pasting and paving the lower protective layer PE membrane 6: in order to prevent damage from outside force during construction and running of the lower surface of the U-shaped expansion joint 7, the lower protective layer PE membrane 6 is required, the lower protective layer PE membrane 6 with a thickness of 0.2 mm is made of glossy PE materials, which can isolate direct contact friction between the impervious composite geomembrane and the rough surface of the concrete cap 13, also can isolate contact friction, bursting and penetration between the composite geomembrane and the padding layer 5, effectively protecting the impervious layer; meanwhile, a low-friction coefficient contact surface provided by the glossy PE membrane, is capable of making the expansion joint freely slide to adapt deformation; paving and bending manners of the lower protective layer PE membrane 6 are kept consistent with the subsequent expansion joints, in order to locate easily, an asphalt layer with a thickness of 0.2 mm is brushed coated on side walls of the concrete cap 13 according to depth of one swing of the subsequent U-shaped expansion joint 7, then one end of the lower protective layer PE membrane is bonded and fixed to side walls of the concrete cap 13, the other parts are lined at lower part of the U-shaped expansion joint, that is, complying with lower surfaces shapes of the U-shaped expansion joint 7 and the assistive horizontal expansion joint 9 to cover and synchronously extend outwardly;

d. paving the U-shaped expansion joint 7: the U-shaped expansion joint 7 is vertically provided, with a U-shaped open end upward, one end of the U-shaped expansion joint 7 is pre-embedded in the concrete cap 13, with a pre-embedding length greater than 150 cm, the other end horizontally extends outwardly, the U-shaped expansion joint 7 has a unidirectional height of 25 cm (which can be determined by the relative deformation between the composite geomembrane and the concrete cap 13); in order to prevent spreading failure of the composite geomembranes after direct contact at both sides of the U-shaped expansion joint, wherein a higher friction force is produced between the composite geomembranes; the U-shaped expansion joint is filled therein with foamed plates with a thickness of 2 cm, and after the foamed plates are set, the padding layer is used for embedding the U-shaped expansion joint;

e. paving the assistive horizontal expansion joint 9: the assistive horizontal expansion joint 9 is required to assist the U-shaped expansion joint 7 and to prevent cofferdam deformation larger than the designed scope of the U-shaped expansion joint 7 due to cofferdam padding material property or poor construction quality; the assistive horizontal expansion joint 9 which is connected to one end of the U-shaped expansion joint 7 at the top surface of the U-shaped expansion joint 7 and at a position 10-20 cm away from the U-shaped expansion joint 7 is set, the other end of the assistive horizontal expansion joint 9 is connected to other impervious geomembranes of the cofferdam; and the horizontal expansion joint is a two-way three-tier horizontally folded structure, a width from both sides to the center is 25 cm, and a glossy PE membrane with a thickness of 0.2 mm is used for separating the two folding contact surfaces, to reduce friction force between folding contact surfaces of the horizontal expansion joints, which is beneficial to making the horizontal expansion joints spread and come into play;

f. pasting and paving the upper layer PE membrane 10: a layer of asphalt with a thickness of 0.2 mm is brush coated on side walls of the concrete cap 13, one end of the upper layer PE membrane 10 is bonded to the asphalt surface, and the other end complies with the upper surface shapes of the U-shaped expansion joint 7 and the assistive horizontal expansion joint 9 to cover and synchronously extend outwardly; and a length beyond the assistive horizontal expansion joint 9 is greater than 10 cm; the upper protective layer PE membrane 10 has the same working mechanism with the lower protective layer PE membrane 6, and protects the upper surface of the expansion joint from damage from outside force during construction and running phases, meanwhile, the upper protective layer PE membrane 10 also provides a low-friction force contact surface to make the expansion joint slide and be deformed; and g. setting aside the lead-out joint 11: the lead-out joint (11) for splicing is set aside at the tail end of the assistive horizontal expansion joint 9 and a geotextile terminal is stripped by 50 cm to make the main membrane exposed, the lead-out joint and a large area of the composite geomembrane at the upstream face of the cofferdam are welded; and finally, a compacted well-graded granular material protective layer is spread above the upper protective layer PE membrane (10).

In this embodiment, the U-shaped expansion joint 7 and the assistive horizontal expansion joint 9 are used as strain buffer devices, one end thereof is connected to the concrete toe slab 1 or the concrete cap 13, and the other end thereof provides the lead-out joint 11 to connect to a large area of impervious composite geomembranes at the upstream face of the cofferdam, PE membranes in the composite geomembranes are connected via bonding or welding, the length for welding is not less than 10 cm, bonding method is applied when local welding failure is observed, with a lap joint not less than 15 cm, the geotextiles at both sides are bonded or sewn, the seam stitching strength of the PE membranes is not less than tensile strength of the matrix, and the seam stitching strength of the geotextiles is not less than 70% of that of the matrix.

What is claimed is:

1. A cofferdam deformation-adaptive composite geomembrane impervious structure, comprising a concrete structure and a padding layer rigidly connected to the concrete structure, and a composite geomembrane with an impervious function provided between the concrete structure and the padding layer; wherein the composite geomembrane comprises an upper protective layer polyethylene (PE) membrane, a lower protective layer polyethylene (PE) membrane, a U-shaped expansion joint and an assistive horizontal expansion joint, wherein the U-shaped expansion joint is vertically disposed with a U-shaped open end facing upward, one end of the U-shaped expansion joint is fixed to the concrete structure and the other end of the U-shaped expansion joint extend horizontally and is connected to one end of the assistive horizontal expansion joint, and the other end of the assistive horizontal expansion joint is connected to other impervious geomembranes of the cofferdam; one ends of both of the upper protective layer PE membrane and lower protective layer PE membrane are bonded to the concrete structure, and the other ends comply with shapes of the U-shaped expansion joint and the assistive horizontal expansion joint to cover and synchronously extend outwardly; and the assistive horizontal expansion joint is a two-way three-tier horizontally folded structure.

2. The composite geomembrane impervious structure according to claim 1, wherein a U-shaped groove of the U-shaped expansion joint is filled with foamed plates.

3. The composite geomembrane impervious structure according to claim 2, wherein a glossy polyethylene (PE) membrane is lined between two folding contact surfaces of the assistive horizontal expansion joint, and a lead-out joint for splicing is set aside at a tail end of the assistive horizontal expansion joint.

4. The composite geomembrane impervious structure according to claim 3, wherein the concrete structure is a concrete toe slab, wherein one side of the toe slab is provided with shoreside bed rocks and the other side is connected to the padding layer, a bottom plate of the concrete toe slab is connected to the shoreside bed rocks through anchor bars and consolidation grouting and is provided with a grouting curtain along an axis of the concrete toe slab, an inner end of the U-shaped expansion joint is pre-embedded in the concrete toe slab, inner ends of the upper protective layer PE membrane and lower protective layer PE membrane are bonded to a surface of the concrete toe slab through asphalt, and subsequent parts of the upper protective layer PE membrane and the lower protective layer PE membrane are coated on surfaces of the U-shaped expansion joint and the assistive horizontal expansion joint.

5. The composite geomembrane impervious structure according to claim 3, wherein the concrete structure is a concrete impervious wall, wherein an upper end of the impervious wall is provided with a concrete cap and a guide wall; wherein an inner end of the U-shaped expansion joint is pre-embedded in the concrete cap, and inner ends of the upper protective layer PE membrane and lower protective layer PE membrane are bonded to a surface of the concrete cap through asphalt, and subsequent parts of the upper protective layer PE membrane and lower protective layer PE membrane are coated on surfaces of the U-shaped expansion joint and the assistive horizontal expansion joint.

6. A construction method of the composite geomembrane impervious structure according to claim 4, comprising the following steps:

setting the concrete toe slab and an impervious system: one side of the concrete toe slab is provided with shoreside bed rocks and the other side is connected to the padding layer, the bottom plate of the concrete toe slab is connected to the shoreside bed rocks through anchor bars and consolidation grouting and is provided with the grouting curtain along the axis of the concrete toe slab; the concrete toe slab has a thickness of 1.5 m, and settlement joints are provided on the concrete toe slab along direction of axis thereof every 9-12 m; and the grouting curtain has a depth ranged within 5 Lu-10 Lu;

setting the padding layer: the padding layer is prepared by employing well-graded natural gravels or artificial sand-mixed natural gravels, filling and compacting, with thickness of 60 cm and a maximum granule diameter less than 4 cm;

pasting and paving the lower protective layer PE membrane: a layer of asphalt with a thickness of 0.2 mm is brush coated on a side wall of the concrete toe slab according to depth of one swing of subsequent U-shaped expansion joints, one end of the lower protective layer PE membrane is bonded to the asphalt surface and the other end complies with the lower surface shapes of the U-shaped expansion joint and the assistive horizontal expansion joint to cover and synchronously extend outwardly; and the lower protective layer PE membrane is made of a glossy high density polyethylene (HDPE) material, with a membrane thickness of 0.2 mm;

paving the U-shaped expansion joint: the U-shaped expansion joint is vertically provided, with a U-shaped open end upward, one end of the U-shaped expansion joint is pre-embedded in the concrete toe slab, with a pre-embedding length more than 150 cm, the other end horizontally extends outwardly, the U-shaped expansion joint has a unidirectional height of 25 cm and is filled therein with foamed plates with a thickness of 2 cm;

paving the assistive horizontal expansion joint: the assistive horizontal expansion joint which is connected to one end of the U-shaped expansion joint at a top surface of the U-shaped expansion joint and at a position 10-20 cm away from the U-shaped expansion joint, is set, the other end of the assistive horizontal expansion joint is connected to other impervious geomembranes of the cofferdam; and the horizontal expansion joint is a two-way three-tier horizontally folded structure, a width from both sides to the center is 25 cm, and a glossy polyethylene (PE) membrane with a thickness of 0.2 mm is used for separating the two folding contact surfaces;

pasting and paving the upper layer PE membrane: a layer of asphalt with a thickness of 0.2 mm is brush coated on side walls of the concrete toe slab, one end of the upper layer PE membrane is brush coated on the asphalt surface, and the other end complies with the upper surface shapes of the U-shaped expansion joint and the assistive horizontal expansion joint to cover and synchronously extend outwardly; and a length beyond the assistive horizontal expansion joint is more than 10 cm; and setting aside the lead-out joint: the lead-out joint for splicing is set aside at the tail end of the assistive horizontal expansion joint and a geotextile terminal is stripped by 50 cm to make a main membrane exposed, the lead-out joint and a large area of the composite geomembrane at an upstream face of the cofferdam are welded; and finally, a concrete protective layer is sprayed above the upper protective layer PE membrane.

7. A construction method of the composite geomembrane impervious structure according to claim 5, comprising the following steps:

setting the concrete impervious wall and an impervious system: an upper end of the concrete impervious wall is provided with the concrete cap and the guide wall, and both sides of the concrete cap are connected to the padding layer;

setting the padding layer: the padding layer is prepared by employing well-graded natural gravels or artificial sand-mixed natural gravels, filling and compacting, with a thickness of 60 cm and a maximum particle diameter less than 4 cm;

pasting and paving the lower protective layer PE membrane: a layer of asphalt with a thickness of 0.2 mm is brush coated on a side wall of the concrete cap 13 according to depth of one swing of the subsequent U-shaped expansion joint, one end of the lower protective layer PE membrane is bonded to the asphalt surface and the other end complies with the lower surface shapes of the U-shaped expansion joint and the assistive horizontal expansion joint to cover and synchronously extend outwardly; and the lower protective layer PE membrane is made of a glossy high density polyethylene (HDPE) material, with a membrane thickness of 0.2 mm;

paving the U-shaped expansion joint: the U-shaped expansion joint is vertically provided, with a U-shaped open end facing upward, one end of the U-shaped expansion joint is pre-embedded in the concrete cap, with a pre-embedding length greater than 150 cm, the other end horizontally extends outwardly, the U-shaped expansion joint has a unidirectional height of 25 cm and is filled therein with foamed plates with a thickness of 2 cm;

paving the assistive horizontal expansion joint: the assistive horizontal expansion joint which is connected to one end of the U-shaped expansion joint at a top surface of the U-shaped expansion joint and at a position 10-20 cm away from the U-shaped expansion joint, is set, the other end of the assistive horizontal expansion joint is connected to other impervious geomembranes of the cofferdam; and the horizontal expansion joint is a two-way three-tier horizontally folded structure, a width from both sides to the center is 25 cm, and a glossy PE membrane with a thickness of 0.2 mm is used for separating the two folding contact surfaces;

pasting and paving the upper layer PE membrane: a layer of asphalt with a thickness of 0.2 mm is brush coated on side walls of the concrete cap, one end of the upper layer PE membrane is bonded to the asphalt surface, and the other end complies with the upper surface shapes of the U-shaped expansion joint and the assistive horizontal expansion joint to cover and synchronously extend outwardly; and a length beyond the assistive horizontal expansion joint is greater than 10 cm; and setting aside the lead-out joint: the lead-out joint for splicing is set aside at the tail end of the assistive horizontal expansion joint and a geotextile terminal is stripped by 50 cm to make a main membrane exposed, the lead-out joint and a large area of the composite geomembrane at an upstream face of the cofferdam are welded; and finally, a compacted well-graded granular material protective layer is spread above the upper protective layer PE membrane.

* * * * *